US008152169B2

(12) United States Patent
Samoto et al.

(10) Patent No.: US 8,152,169 B2
(45) Date of Patent: Apr. 10, 2012

(54) FEEDING DEVICE AND IMAGE RECORDING APPARATUS WITH THE FEEDING DEVICE

(75) Inventors: Kenji Samoto, Nagoya (JP); Yuji Koga, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 130 days.

(21) Appl. No.: 12/706,607

(22) Filed: Feb. 16, 2010

(65) Prior Publication Data

US 2010/0207321 A1 Aug. 19, 2010

(30) Foreign Application Priority Data

Feb. 16, 2009 (JP) ..... 2009-032879

(51) Int. Cl.
*B65H 39/10* (2006.01)

(52) U.S. Cl. ..... 271/301; 271/303; 271/65; 399/309

(58) Field of Classification Search ..... 271/186, 271/291, 65, 301, 303, 304; 399/309, 364
See application file for complete search history.

(56) References Cited

U.S. PATENT DOCUMENTS

| | | | | |
|---|---|---|---|---|
| 4,486,012 | A * | 12/1984 | Bock et al. | 271/3.15 |
| 6,446,958 | B1 * | 9/2002 | Sette et al. | 271/225 |
| 7,410,167 | B2 * | 8/2008 | Koga et al. | 271/266 |
| 2008/0205954 | A1 | 8/2008 | Sugiyama et al. | |
| 2009/0026685 | A1 * | 1/2009 | Uchino et al. | 270/18 |
| 2010/0225050 | A1 | 9/2010 | Tanahashi | |

FOREIGN PATENT DOCUMENTS

| | | | |
|---|---|---|---|
| JP | S59-193469 | A | 11/1984 |
| JP | 2002-037500 | A | 2/2002 |
| JP | 2004-250222 | A | 9/2004 |
| JP | 2006-193328 | A | 7/2006 |
| JP | 2008-213979 | A | 9/2008 |
| JP | 2008-239306 | A | 10/2008 |
| JP | 2010-208718 | A | 9/2010 |

OTHER PUBLICATIONS

The State Intellectual Property Office of the People's Republic of China, Notification of First Office Action for Japanese Patent Application No. 201010121700.8 (counterpart to above-captioned patent application), issued Aug. 3, 2011.

Japan Patent Office, Decision to Grant a Patent for Japanese Patent Application No. 2010-006937 (counterpart to above-captioned patent application), mailed Nov. 1, 2011.

* cited by examiner

*Primary Examiner* — Michael McCullough
(74) *Attorney, Agent, or Firm* — Baker Botts L.L.P.

(57) ABSTRACT

A feeding device includes a conveying roller that conveys a sheet downstream when the conveying roller rotates forward. A first guide member guides the conveyed sheet toward the conveying roller. A second guide member guides the sheet when the conveying roller rotates in reverse. A rotating member is positioned between the first guide member and the conveying roller, and has a support shaft and a pressing portion. The rotating member rotates about the support shaft between a first supported state where the rotating member is separated from the second guide member, and a second supported state where the rotating member is closer to the second guide member. In the first supported state, the sheet is conveyed from the first guide member to the conveying roller. A trailing end of the sheet moves toward the second guide member when the rotating member transitions from the first to the second supported state.

18 Claims, 12 Drawing Sheets

FEEDING DEVICE AND IMAGE RECORDING APPARATUS WITH THE FEEDING DEVICE

CROSS REFERENCE TO RELATED APPLICATION

The present application claims priority from Japanese Patent Application No. 2009-032879, which was filed on Feb. 16, 2009, the disclosure of which is incorporated herein by reference in its entirety.

BACKGROUND OF THE INVENTION

1. Field of the Invention

The present invention relates to a feeding device and an image recording apparatus having a mechanism for sending a sheet with an image recorded on one side thereof back to the recording unit.

2. Description of the Related Art

Conventionally, feeding devices capable of switching the traveling direction of the sheet to feed to another path are known. In such a feeding device, a rotating member rotates after a trailing end of the sheet conveyed in a first conveying path has passed through, the traveling direction is switched, and the trailing end of the sheet, which is reversed and becomes a new leading end of the sheet, contacts the rotated rotating member to be guided to a second conveying path.

In such a feeding device, since the trailing end of the sheet is reversed and becomes a new leading end of the sheet, and contacts the rotated rotating member to be guided to a second conveying path, the trailing end of the sheet is at risk of being damaged when it contacts the rotating member. Furthermore, since the rotating member does not rotate until the trailing end of the sheet has passed through the rotating member, a certain distance to a reversing roller which switches the traveling direction of the sheet is necessary, resulting in a problem in that a device becomes larger in size.

SUMMARY OF THE INVENTION

It is an object of the present invention to provide a downsized feeding device and an image recording apparatus with the feeding device, which is capable of switching the traveling direction of the sheet with less damage to the trailing end of the sheet which is reversed and becomes a new leading end of the sheet, and in which the distance from the rotating member to the reversing roller is short.

In an embodiment of the invention, a feeding device comprises a conveying roller configured to selectively rotate in a forward direction and a reverse direction, the conveying roller configured to convey a sheet toward a downstream side in a conveying direction when the conveying roller is rotated in the forward direction, a first guide member positioned on an upstream side of the conveying roller in the conveying direction and configured to guide the conveyed sheet toward the conveying roller, a second guide member configured to guide the conveyed sheet when the conveying roller rotates in the reverse direction, and a rotating member positioned between the first guide member and the conveying roller and comprising a support shaft and a pressing portion. The rotating member is configured to rotate about the support shaft between a first supported state where the rotating member is separated from the second guide member, and a second supported state where the rotating member is closer to the second guide member than when the rotating member is in the first supported state. When the rotating member is in the first supported state, the rotating member is positioned to allow the sheet to be conveyed from the first guide member to the conveying roller, and wherein the rotating member is configured to move a trailing end of the sheet toward the second guide member by transitioning from the first supported state to the second supported state.

In another embodiment of the invention, an image recording apparatus comprises a recording unit configured to record an image on a recording medium, and a feeding device. The feeding device comprises a conveying roller configured to selectively rotate in a forward direction and a reverse direction, the conveying roller configured to convey a sheet toward a downstream side in a conveying direction when the conveying roller is rotated in the forward direction, a first guide member positioned on an upstream side of the conveying roller in the conveying direction and configured to guide the conveyed sheet toward the conveying roller, a second guide member configured to guide the conveyed sheet when the conveying roller rotates in the reverse direction, and a rotating member positioned between the first guide member and the conveying roller and comprising a support shaft and a pressing portion. The rotating member is configured to rotate about the support shaft between a first supported state where the rotating member is separated from the second guide member, and a second supported state where the rotating member is closer to the second guide member than when the rotating member is in the first supported state. When the rotating member is in the first supported state, the rotating member is positioned to allow the sheet to be conveyed from the first guide member to the conveying roller, and wherein the rotating member is configured to move a trailing end of the sheet toward the second guide member by transitioning from the first supported state to the second supported state.

According to the feeding device and the image recording apparatus with the feeding device of the present invention, damage to the trailing end of the sheet which is reversed and becomes a new leading end of the sheet can be reduced. Furthermore, since the distance from the rotating member to the reversing roller is short, the feeding device or the image recording apparatus with the feeding device can be downsized.

Other objects, features, and advantages of embodiments of the present invention will be apparent to persons of ordinary skill in the art from the following description of preferred embodiments with reference to the accompanying drawings.

DESCRIPTION OF THE PREFERRED EMBODIMENTS

Figure 1:
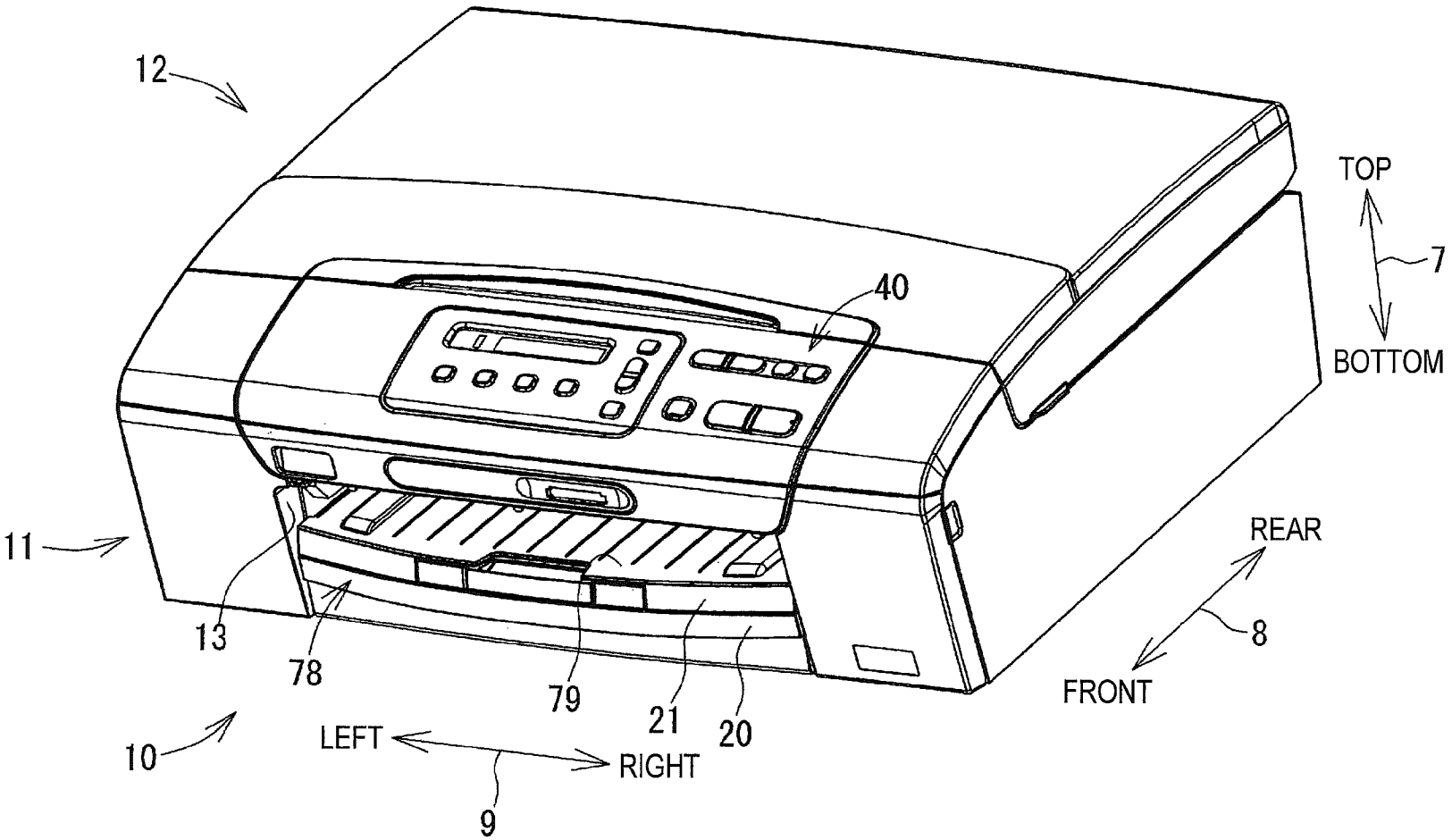
FIG. 1 is a perspective view showing the exterior of a multifunction device according to an embodiment of the present invention.

Referring to the drawings, preferred embodiments of the present invention will be described below. Note that the embodiments described below are merely examples of the present invention, and the embodiments of the present invention can of course be modified within the scope not changing the gist of the present invention.

[Outline of the Multifunction Device]

FIG. 1 is a perspective view showing the exterior of a multifunction device 10 according to an embodiment of the present invention. In the following description, a top-bottom direction 7 is defined based on a state in which the multifunction device 10 is installed in a usable state (the state shown in FIG. 1), a front-rear direction 8 is defined such that the side having an operation panel 40 is the near side (front), and a left-right direction 9 is defined by viewing the multifunction device 10 from the near side (front).

The multifunction device 10 has a substantially thin rectangular parallelepiped shape, having larger transverse width (the width in the left-right direction 9) and depth (the length in the front-rear direction 8) than height (the top-bottom direction 7). The multifunction device 10 mainly includes a printer unit 11 employing an ink jet recording method and provided at the lower part, a scanner unit 12 provided at the upper part, and the operation panel 40 provided at the front of the top surface. The multifunction device 10 has various functions including a facsimile function, a printer function, a scanner function, and a copier function. The printer function of the multifunction device 10 includes a duplex image recording function for recording images on both sides, i.e., a top surface (a first surface) and a back surface (a second surface), of the recording sheet. Because the functions other than the printer function are arbitrary, the image recording apparatus of the present invention may be embodied as, for example, a printer not having a scanner function, a copier function, or a facsimile function, but having only a printer function.

The printer unit 11 has an opening 13 in the front thereof, through which a sheet-feed cassette 78 is fitted into the printer unit 11. The sheet-feed cassette 78 can be inserted into and removed from the printer unit 11 in the front-rear direction 8 through the opening 13. The sheet-feed cassette 78 can accommodate recording sheets (an example of a sheet of the present invention) of various sizes and includes a main tray 20 at the bottom and a second tray 21 at the top. That is, the second tray 21 is stacked on the main tray 20. An output-sheet holder 79 for holding the recording sheets after image recording, output thereon, is provided above the front side of the second tray 21.

[Structure of Printer Unit]

Figure 2:
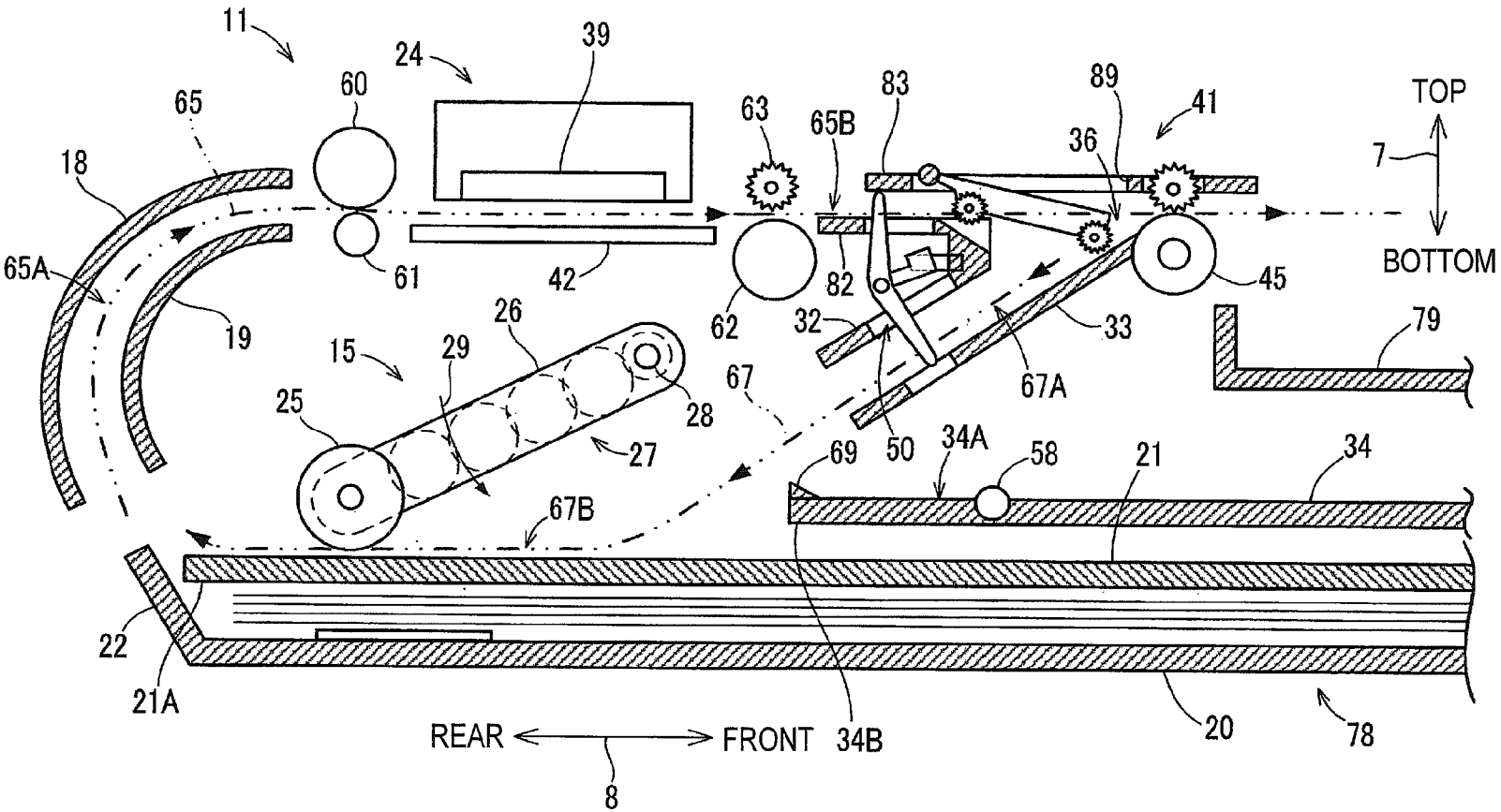
FIG. 2 is a vertical cross section showing the structure of a printer unit.

Referring to FIG. 2, the structure of the printer unit 11 will be described. FIG. 2 is a vertical cross section showing the internal structure of the printer unit 11. In FIG. 2, the front side of the sheet-feed cassette 78 (the right side in the sheet) is not shown.

The printer unit 11 includes, in addition to the above-described sheet-feed cassette 78, a feed unit 15 that picks a recording sheet from the sheet-feed cassette 78 to feed (send) the sheet, a recording unit 24 (an example of the recording unit of the present invention) employing an ink jet recording method and discharging ink droplets onto the recording sheet fed by the feed unit 15 to form an image on the recording sheet, and a path-switching portion 41 that switches the conveying path of the recording sheet after image recording so that an image is recorded on the back surface (the second surface) of the top surface (the first surface). Note that the recording unit 24 may employ not only an ink jet method, but also various recording methods such as an electrophotography method and a thermal recording method.

[Conveying Path]

The printer unit 11 has, inside thereof, a conveying path 65 extending from an end (a rear end) of the main tray 20 through the recording unit 24 to the output-sheet holder 79. The conveying path 65 includes a curved path 65A formed between the end of the main tray 20 and the recording unit 24 and a sheet output path 65B formed between the recording unit 24 and the output-sheet holder 79.

As shown in FIG. 2, the curved path 65A extends from the vicinity of the upper end of an inclined separator plate 22 provided at the main tray 20 to the recording unit 24. The curved path 65A has a substantially arch shape with the center at the inside of the printer unit 11. The curved path 65A is defined by an outer guide member 18 and an inner guide member 19 that are opposed to each other with a predetermined distance therebetween. Note that the outer guide member 18, the inner guide member 19, an upper guide member 83, a lower guide member 82, an upper inclined guide member 32, and a lower inclined guide member 33 (described below) all extend perpendicular to the plane of the sheet of FIG. 2 (the left-right direction 9 in FIG. 1).

The sheet output path 65B is defined by the lower guide member 82 (an example of a first guide member of the present invention) and the upper guide member 83 provided on the downstream side of the recording unit 24 in the conveying direction (hereinafter simply referred to as the "downstream side"). Herein, the conveying direction means a direction in which the recording sheet is conveyed along the conveying path 65 or a reverse-conveying path 67 (described below) (the direction indicated by a two-dot chain line with arrow heads in FIG. 2).

Figure 3A:
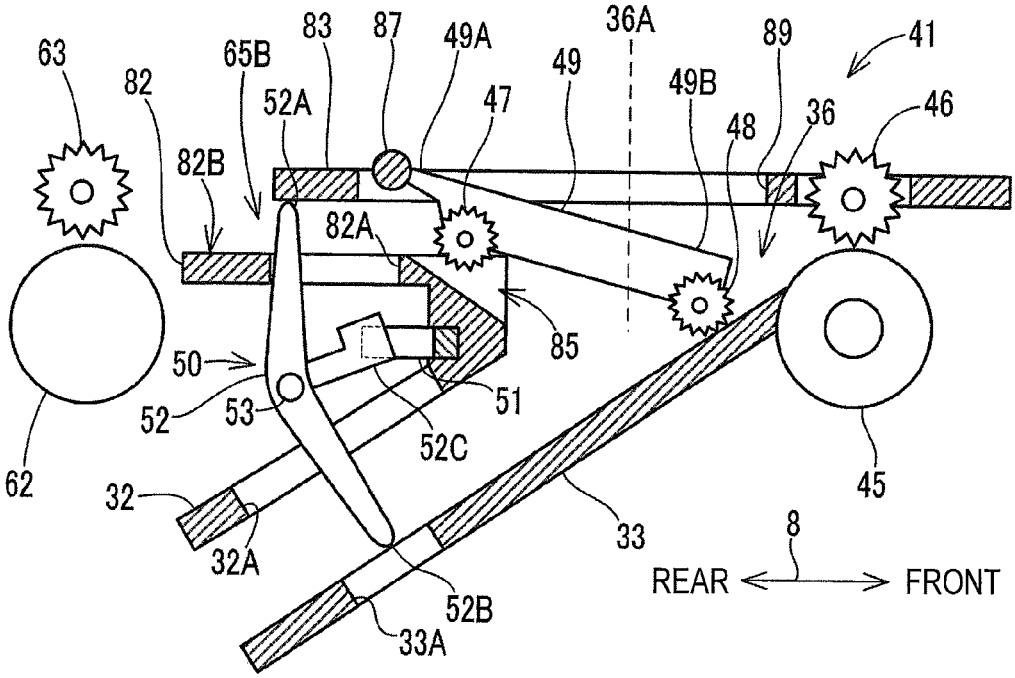
FIGS. 3A and 3B are partial enlarged cross sections showing the structure near a sheet output path.
Figure 3B:
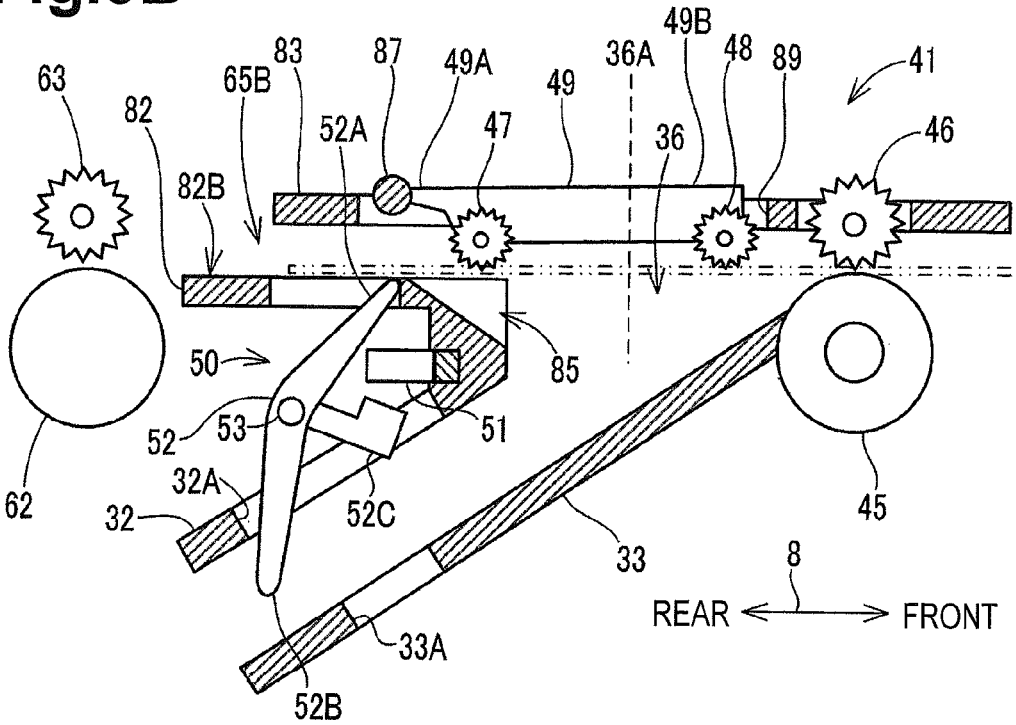

FIGS. 3A and 3B are partial enlarged cross sections showing the structure near the sheet output path 65B. As shown in FIGS. 3A and 3B, the lower guide member 82 horizontally extends frontward (the right side in FIGS. 3A and 3B) from the nip position of a second conveying roller 62 and a spur roller 63 (described below). The sheet output path 65B guides the recording sheet after image recording, conveyed by the second conveying roller 62, to the downstream side by supporting the lower side of the sheet. A branch port 36 is formed on the downstream side of the downstream end of the lower guide member 82. When duplex image recording is to be performed, the recording sheet conveyed along the sheet output path 65B is switched back on the downstream side of the branch port 36 and is then conveyed downward from the branch port 36.

The lower guide member 82 has a long, narrow recess 85 (an example of a recess of the present invention) extending in the front-rear direction 8. The recess 85 is formed at the downstream end of the lower guide member 82. The recess 85 has a long, narrow shape extending in the front-rear direction 8, and the downstream side thereof is open to the branch port 36. The size and position of the recess 85 are designed such that an auxiliary roller 47 (described below) can be inserted into the recess 85. The auxiliary roller 47 will be described below.

The upper guide member 83 is provided above the lower guide member 82. The upper guide member 83 and the lower guide member 82 are opposed to each other with a predetermined distance, allowing a recording sheet to pass, therebetween. The upper guide member 83 extends beyond the branch port 36 to a position above the output-sheet holder 79.

[Reverse-Conveying Path]

As shown in FIG. 2, the printer unit 11 has, inside thereof, the reverse-conveying path 67. The reverse-conveying path 67 branched from the sheet output path 65B at the branch port 36 extends between the sheet-feed cassette 78 and the recording unit 24 provided thereabove, and joins to a position on the upstream side of the recording unit 24 in the conveying direction (hereinafter simply referred to as the "upstream side"), where the beginning end (upstream end) of the curved path 65A merges with the terminal end (downstream side end) of the reverse-conveying path 67.

The reverse-conveying path 67 includes an inclined path 67A and a straight path 67B. The inclined path 67A is defined by the upper inclined guide member 32 and the lower inclined guide member 33 (an example of a second guide member of the present invention) having inclined surfaces that extend obliquely downward to the rear from the branch port 36. The upper inclined guide member 32 is integral with the lower guide member 82. These guide members 32 and 33 are opposed to each other with a predetermined distance, allowing a recording sheet to pass, therebetween. The upper inclined guide member 32 is disposed above the lower inclined guide member 33. These guide members 32 and 33 extend downward from the branch port 36, and, more specifically, they extend obliquely downward to the rear.

The straight path 67B extends linearly from the vicinity of the terminal end of the inclined path 67A. The straight path 67B is defined by a top surface 34A of a slide guide 34 that is supported so as to be slidable in the front-rear direction 8. The slide guide 34 is provided between the second tray 21 and the output-sheet holder 79. The slide guide 34 will be described below.

Because of the thus-formed conveying path 65 and the reverse-conveying path 67, a recording sheet fed by the feed unit 15 from the main tray 20 or the second tray 21 is conveyed to the recording unit 24 through the curved path 65A. At this time, the side of the recording sheet opposite the side having been in contact with a sheet-feed roller 25 of the feed unit 15 faces the recording unit 24. The recording sheet having passed the recording unit 24 passes through the sheet output path 65B and is conveyed to the output-sheet holder 79. Alternatively, the path-switching portion 41 switches the conveying path, and the recording sheet passes through the inclined path 67A and the straight path 67B of the reverse-conveying path 67 and is again conveyed to the recording unit 24. The path-switching portion 41 will be described below.

[Recording Unit]

As shown in FIG. 2, the recording unit 24 is disposed above the sheet-feed cassette 78. The recording unit 24 is configured to reciprocate along a guide rail (not shown) extending in the direction perpendicular to the plane of the sheet of FIG. 2 (a main scanning direction). A platen 42 is provided below the recording unit 24. The platen 42 supports the recording sheet horizontally during image recording by the recording unit 24. While reciprocating in the main scanning direction, the recording unit 24 discharges fine droplets of ink, supplied from an ink cartridge (not shown), through nozzles 39 onto the recording sheet conveyed on the platen 42. Thus, an image is recorded on the recording sheet.

A first conveying roller 60 and a pinch roller 61, forming a pair, are provided between the terminal end of the curved path 65A, i.e., the downstream end of the curved path 65A, and the recording unit 24. The pinch roller 61 is disposed below the first conveying roller 60 and is urged against the roller surface of the first conveying roller 60 by an elastic member such as a spring (not shown). The first conveying roller 60 and the pinch roller 61 nip the recording sheet conveyed along the curved path 65A and send the sheet onto the platen 42.

Furthermore, a second conveying roller 62 and a spur roller 63, forming a pair, are provided between the recording unit 24 and the beginning end of the sheet output path 65B, i.e., the upstream end of the sheet output path 65B. The spur roller 63 is disposed above the second conveying roller 62 and is urged against the roller surface of the second conveying roller 62 by its own weight or a spring. The second conveying roller 62 and the spur roller 63 nip the recording sheet after recording and convey the sheet toward a further downstream side (toward the output-sheet holder 79).

A rotational driving power transmitted by a conveying motor 73 (see FIG. 4) through a drive-transmission mechanism rotates the first and second conveying rollers 60 and 62. The drive-transmission mechanism includes a planetary gear and rotates the first and second conveying rollers 60 and 62 in one direction so that the recording sheet is conveyed to one direction (to the right in FIG. 2), regardless of the rotational direction of the conveying motor 73. Note that the first and second conveying rollers 60 and 62 are driven in an intermittent manner during image recording. Thus, image recording is performed while the recording sheet is sent at a predetermined line width.

[Feed Unit]

The feed unit 15 conveys the recording sheets accommodated in the sheet-feed cassette 78 toward the curved path 65A. The feed unit 15 includes the sheet-feed roller 25, a sheet-feed arm 26, and a drive-transmission mechanism 27. The sheet-feed roller 25 is disposed above the sheet-feed cassette 78. The sheet-feed roller 25 supported so as to be rotatable at an end of the sheet-feed arm 26 feeds the recording sheets accommodated in the main tray 20 or second tray 21 of the sheet-feed cassette 78 to the curved path 65A. The sheet-feed roller 25 is rotationally driven by a sheet-feed motor 71 (see FIG. 4) via the drive-transmission mechanism 27. The drive-transmission mechanism 27 is supported by the sheet-feed arm 26 and includes a plurality of gears that are arranged substantially linearly.

A base shaft 28 is provided above the straight path 67B, which is formed above the sheet-feed cassette 78, and below the recording unit 24. That is, the base shaft 28 is provided between the straight path 67B and the recording unit 24. The sheet-feed arm 26 is supported by the base shaft 28 at the base end thereof and is rotatable about the base shaft 28. Thus, the sheet-feed arm 26 can move vertically toward and away from the main tray 20. Furthermore, the sheet-feed arm 26 is rotationally urged in the direction indicated by an arrow 29 in FIG. 2 by its own weight or an elastic force exerted by an elastic member such as a spring. Therefore, the sheet-feed roller 25 can be urged against the top surface of the recording sheets accommodated in the sheet-feed cassette 78. When the sheet-feed cassette 78 is inserted into the printer unit 11, the rear end (for example, the inclined separator plate 22) of the sheet-feed cassette 78 pushes the sheet-feed arm 26 upward.

[Sheet-Feed Cassette]

The sheet-feed cassette 78 is provided below the feed unit 15. The main tray 20 of the sheet-feed cassette 78 has an open-top rectangular box shape and is disposed at the bottom of the printer unit 11. The main tray 20 can accommodate recording sheets of letter size (216 mm×274 mm), legal size (216 mm×356 mm), A4 size (210 mm×297 mm), and smaller sizes. The multifunction device 10 according to this embodiment accommodates mainly A4-sized and B5-sized recording sheets in the main tray 20.

The second tray 21 is disposed above the main tray 20. In this embodiment, the second tray 21 can accommodate recording sheets with a maximum size of postcard size (100×148 mm) and mainly accommodates recording sheets of postcard size and photo L size (postcard, glossy paper, and the like). Similarly to the main tray 20, the second tray 21 may accommodate recording sheets having a size larger than postcard size, for example, A4-sized recording sheets.

The second tray 21 is supported above the main tray 20 so as to be slidable in the front-rear direction 8. More specifically, the second tray 21 slides between a rear position (the position shown in FIG. 2) where a rear end 21A thereof is in contact with the inclined separator plate 22 (described below) and a front position where the rear end 21A is a predetermined distance away from the inclined separator plate 22, toward the front.

When the second tray 21 is disposed at the front position, the rear side of the top surface of the main tray 20 is open. At this time, the sheet-feed roller 25 extends through the opening in the rear side of the top surface of the main tray 20 and is in contact with the recording sheets accommodated in the main tray 20. When the sheet-feed roller 25 is rotated in this state, the recording sheets accommodated in the main tray 20 are fed toward the curved path 65A.

When the second tray 21 is slid from the front position to the rear position, the rear end 21A of the second tray 21 presses the sheet-feed arm 26, pushing the sheet-feed arm 26 upward. As a result, the sheet-feed roller 25 is disposed on the second tray 21, as shown in FIG. 2. When the sheet-feed roller 25 is disposed on the second tray 21, the sheet-feed roller 25 is in contact with the top surface of the recording sheets accommodated in the second tray 21. When the sheet-feed roller 25 is rotated in this state, the recording sheets accommodated in the second tray 21 begin to be fed toward the curved path 65A.

Examples of a slide-support mechanism for the second tray 21 include a slide-support mechanism consisting of a rail (not shown) provided on the main tray 20 and a slide groove (not shown) provided on the bottom surface of the second tray 21, and other known support mechanisms. Furthermore, the second tray 21 may be moved either by hand or by a motive power transmitted from a motor via a known transmission mechanism (for example, a rack-and-pinion mechanism). Note that the support mechanism for the second tray 21 is not limited to one that supports it in a slidable manner, but may be any support mechanisms that support the second tray 21 above the main tray 20 in a movable manner in the front-rear direction 8.

The output-sheet holder 79 is provided above the front side of the second tray 21. The recording sheets after image recording are output and held on the top surface of the output-sheet holder 79. The output-sheet holder 79 may be either integral with the sheet-feed cassette 78 such that it can be inserted into and removed from the printer unit 11, or fixed to the frame of the printer unit 11.

The slide guide 34 is a plate-like member that is supported so as to be slidable by the frame of the printer unit 11 or the output-sheet holder 79 fixed to the frame. The slide guide 34 is supported so as to be slidable in the front-rear direction 8, between a retracted position, as shown in FIG. 2, and a guide position, as shown in FIG. 8F. At the refracted position, a rear end 34B of the slide guide 34 is retracted toward the front of the feed unit 15. At the guide position, the rear end 34B of the slide guide 34 is close to the curved path 65A.

Examples of a slide-support mechanism for the slide guide 34 include, similarly to the slide-support mechanism for the second tray 21, a slide-support mechanism consisting of a rail and a slide groove, and other known support mechanisms. Furthermore, the slide guide 34 may be moved either by hand or by a motive power transmitted from a motor via a known transmission mechanism (for example, a rack-and-pinion mechanism). Note that the support mechanism for the slide guide 34 is not limited to one that supports it in a slidable manner, but may be any support mechanisms that support the slide guide 34 in a movable manner between the guide position (see FIG. 8F) and the retracted position (see FIG. 2).

An inclined guide 69 is disposed at the rear end 34B of the slide guide 34. The inclined guide 69 has an inclined surface that extends obliquely upward to the rear from the rear end 34B. When the slide guide 34 is at the guide position, an extended plane of the inclined surface of the inclined guide 69 is continuous with the curved path 65A. Therefore, the recording sheets being conveyed along the reverse-conveying path 67 are smoothly guided from the straight path 67B to the curved path 65A by the inclined guide 69.

When the second tray 21 is at the rear position shown in FIG. 2, once the slide guide 34 is slid from the retracted position (see FIG. 2) to the guide position (see FIG. 8F), the rear end 34B of the slide guide 34 presses the sheet-feed arm 26 of the feed unit 15 to the rear (the left side in FIG. 2), pushing the sheet-feed arm 26 upward. As a result, as shown in FIG. 8F, the sheet-feed roller 25 is disposed on the slide guide 34 and comes into contact with the top surface 34A of the slide guide 34. This makes it possible to feed recording sheets passing over the slide guide 34 to the curved path 65A, while the sheet-feed roller 25 is disposed on the slide guide 34. The slide guide 34 has a roller 58 that is supported in a rotatable manner at a position facing the sheet-feed roller 25. The roller 58 is exposed from the top surface 34A. When the sheet-feed roller 25 is disposed on the slide guide 34, the roller surface of the sheet-feed roller 25 is in contact with the roller 58. The recording sheets passing over the slide guide 34 are conveyed by the sheet-feed roller 25 and the roller 58, as will be described below. Thus, the recording sheets can be smoothly conveyed without receiving large frictional resistance from the slide guide 34.

When the slide guide 34 is slid from the guide position to the retracted position, the sheet-feed roller 25 falls from the slide guide 34 and is disposed on the second tray 21 so as to be in contact with the recording sheet in the second tray 21. In this state, the recording sheets accommodated in the second tray 21 can be fed to the curved path 65A.

[Path-Switching Portion]

Referring to FIGS. 3A and 3B, the path-switching portion 41 will be described. The path-switching portion 41 is disposed near the branch port 36 of the sheet output path 65B, i.e., the connecting portion of the sheet output path 65B and the reverse-conveying path 67. As shown in FIGS. 3A and 3B, the path-switching portion 41 includes a third conveying roller 45 (an example of a conveying roller of the present invention), a spur roller 46, and a flap 49 (an example of a rotating member of the present invention) having an auxiliary roller 47 (an example of a protruding portion of the present invention) and an auxiliary roller 48 (an example of a pressing portion of the present invention).

The third conveying roller 45 is provided on the downstream side of the lower guide member 82. The branch port 36 is formed between the third conveying roller 45 and the lower guide member 82. The third conveying roller 45 is supported by, for example, the frame of the printer unit 11 so as to be rotatable. The spur roller 46 is disposed above the third conveying roller 45 and is urged against the roller surface of the third conveying roller 45 by its own weight or a spring. The spur roller 46 is supported at the downstream end of the upper guide member 83 so as to be rotatable. The third conveying roller 45 receives driving power in a forward- or reverse-rotation direction transmitted from the conveying motor 73 (see FIG. 4) and is rotationally driven in the forward- or reverse-rotation direction. For example, when recording is performed on one side, the third conveying roller 45 is rotated in the forward-rotation direction. As a result, the recording sheet nipped by the third conveying roller 45 and the spur roller 46 is conveyed to the downstream side and is output onto the output-sheet holder 79. On the other hand, when recording is performed on both sides, while the third conveying roller 45 and the spur roller 46 nip the rear end of the recording sheet, the rotation direction of the third conveying roller 45 is switched from the forward-rotation direction to the reverse-rotation direction. The operations of the path-switching portion 41 and the recording sheet during recording on one side and both sides will be described below.

The third conveying roller 45 and the spur roller 46 nip the recording sheet sent from the second conveying roller 62 and the spur roller 63. When the recording sheet enters the nip portion between the third conveying roller 45 and the spur roller 46, the recording sheet is nipped by the third conveying roller 45 and the spur roller 46 and is conveyed toward the direction corresponding to the rotation direction of the third conveying roller 45 (toward the output-sheet holder 79 or the inclined path 67A). That is, the third conveying roller 45 and the spur roller 46 can convey the recording sheet to a further downstream side along the sheet output path 65B (toward the output-sheet holder 79) and can convey the recording sheet to the inclined path 67A of the reverse-conveying path 67.

The upper guide member 83 has a support shaft 87 (an example of a support shaft of the present invention) that extends in a direction perpendicular to the plane of the sheet of FIGS. 3A and 3B (the left-right direction 9 in FIG. 1). The support shaft 87 is provided on the upstream side of the branch port 36. The flap 49 extends substantially toward the downstream side from the support shaft 87. An extended end 49B of the flap 49 reaches a position above the branch port 36, more specifically, a position beyond a central portion 36A of the branch port 36 and close to the third conveying roller 45. The flap 49 is supported by the support shaft 87. More specifically, a base end 49A, on the upstream side, of the flap 49 is supported by the support shaft 87 so as to be rotatable. The support shaft 87 can be provided on, for example, the upper guide member 83 or the frame of the printer unit 11. By bending the base end 49A of the flap 49 in, for example, an L shape and by providing the support shaft 87 on the lower guide member 83, the base end 49A may be supported at the lower guide member 83 so as to be rotatable.

The flap 49 has the auxiliary rollers 47 and 48 supported by shafts, which are disposed at a distance from each other along the flap 49. The auxiliary roller 47 is supported by the shaft at the base end 49A of the flap 49. The auxiliary roller 48 is supported by the shaft at the extended end 49B of the flap 49. The roller surfaces of these auxiliary rollers 47 and 48 have, similarly to the spur rollers 63 and 46, a spur shape because they are brought into contact with the recording surfaces of the recording sheets. The roller surfaces of these auxiliary rollers 47 and 48 have a spur shape in this embodiment, but they may not have a spur shape.

The flap 49 rotates between a first orientation (the orientation shown in FIG. 3B) where it is positioned above the lower guide member 82 and a second orientation (the orientation shown in FIG. 3A) where the extended end 49B is positioned below the branch port 36. In this embodiment, the upper guide member 83 has an opening 89 into which the flap 49 can fit. When positioned at the first orientation, the flap 49 fits into the opening 89 and is retracted from the sheet output path 65B. When positioned at the second orientation, the flap 49 is exposed from the opening 89, and the auxiliary roller 48 comes into contact with the lower inclined guide member 33. Furthermore, when the auxiliary roller 47 fits into the recess 85 in the lower guide member 82, the auxiliary roller 47 is retracted below a support surface 82B of the lower guide member 82.

[Sheet Sensor]

A sheet sensor 50 for detecting the presence/absence of the recording sheet at the support surface 82B of the lower guide member 82 is provided on the downstream side of the second conveying roller 62. The sheet sensor 50 includes a rotary member 52 having three detectors 52A, 52B, and 52C, and a photo-interrupter 51 having a light-emitting element (for example, a light-emitting diode) and a light-receiving element (for example, a phototransistor) for receiving light emitted from the light-emitting element.

As shown in FIGS. 3A and 3B, the rotary member 52 is provided so as to be rotatable about a support shaft 53 provided on the frame of the printer unit 11. The support shaft 53 is disposed below the lower guide member 82 and above the upper inclined guide member 32. The rotary member 52 includes the first detector 52A, the second detector 52B, and the third detector 52C.

The first detector 52A is an arm-shaped member extending upward from the support shaft 53 and perpendicular to the sheet output path 65B. The first detector 52A projects into the sheet output path 65B from the opening 82A in the lower guide member 82. In other words, the first detector 52A projects upward from the support surface 82B of the lower guide member 82 for supporting the recording sheet. The second detector 52B is an arm-shaped member extending toward the lower inclined guide member 33 from the support shaft 53 and perpendicular to the inclined path 67A. The second detector 52B projects into the inclined path 67A from the opening 32A in the upper inclined guide member 32. Furthermore, the end of the second detector 52B is inserted through the opening 33A in the lower inclined guide member 33. In other words, the second detector 52B projects from the upper inclined guide member 32 toward the lower inclined guide member 30.

The third detector 52C projects substantially frontward from the support shaft 53. The third detector 52C extends so as to divide the angle formed between the first detector 52A and the second detector 52B substantially into two. The photo-interrupter 51 is provided in a space between the lower guide member 82 and the upper inclined guide member 32. In this embodiment, when no external force is applied to the rotary member 52, the third detector 52C extends in the optical path extending between the light-emitting element of the photo-interrupter 51 and the light-receiving element to block the light passing through this optical path.

Thus, because the rotary member 52 has the first detector 52A and the second detector 52B, if an external force, due to the recording sheet colliding with the first detector 52A or the second detector 52B, is applied, as shown in FIG. 3B, the recording sheet pushes and rotates the rotary member 52 clockwise (right rotation in FIGS. 3A and 3B) about the support shaft 53. Along with the rotation of the first detector 52A or the second detector 52B, the third detector 52C also rotates. As a result, the third detector 52C is retracted from the optical path of the photo-interrupter 51, and the light emitted from the light-emitting element passes through the optical path and is received by the light-receiving element. At this time, an output signal output from the light-receiving element of the photo-interrupter 51 changes. More specifically, the signal level of the output signal changes from LOW to HIGH. On the basis of the change in signal level, a control unit 90 detects the presence/absence of the recording sheet passing through the sheet output path 65B or the inclined path 67A and the position of the leading end or trailing end of the recording sheet in the traveling direction.

Even if the rotary member 52 is rotated to a position shown in FIG. 3B, because an elastic member (not shown) such as a torsion coil spring is attached to the support shaft 53, once the urging force is released, the rotary member 52 returns to the original state, shown in FIG. 3A, due to the elastic force exerted by the elastic member. As a result, the third detector 52C enters the optical path of the photo-interrupter 51, blocking the light passing through the optical path. At this time, the signal level of the output signal of the light-receiving element of the photo-interrupter 51 changes from HIGH to LOW. On the basis of the change in signal level, the control unit 90 detects the presence/absence and position of the trailing end of the recording sheet passing through the sheet output path 65B or the inclined path 67A in the traveling direction.

Figure 4:
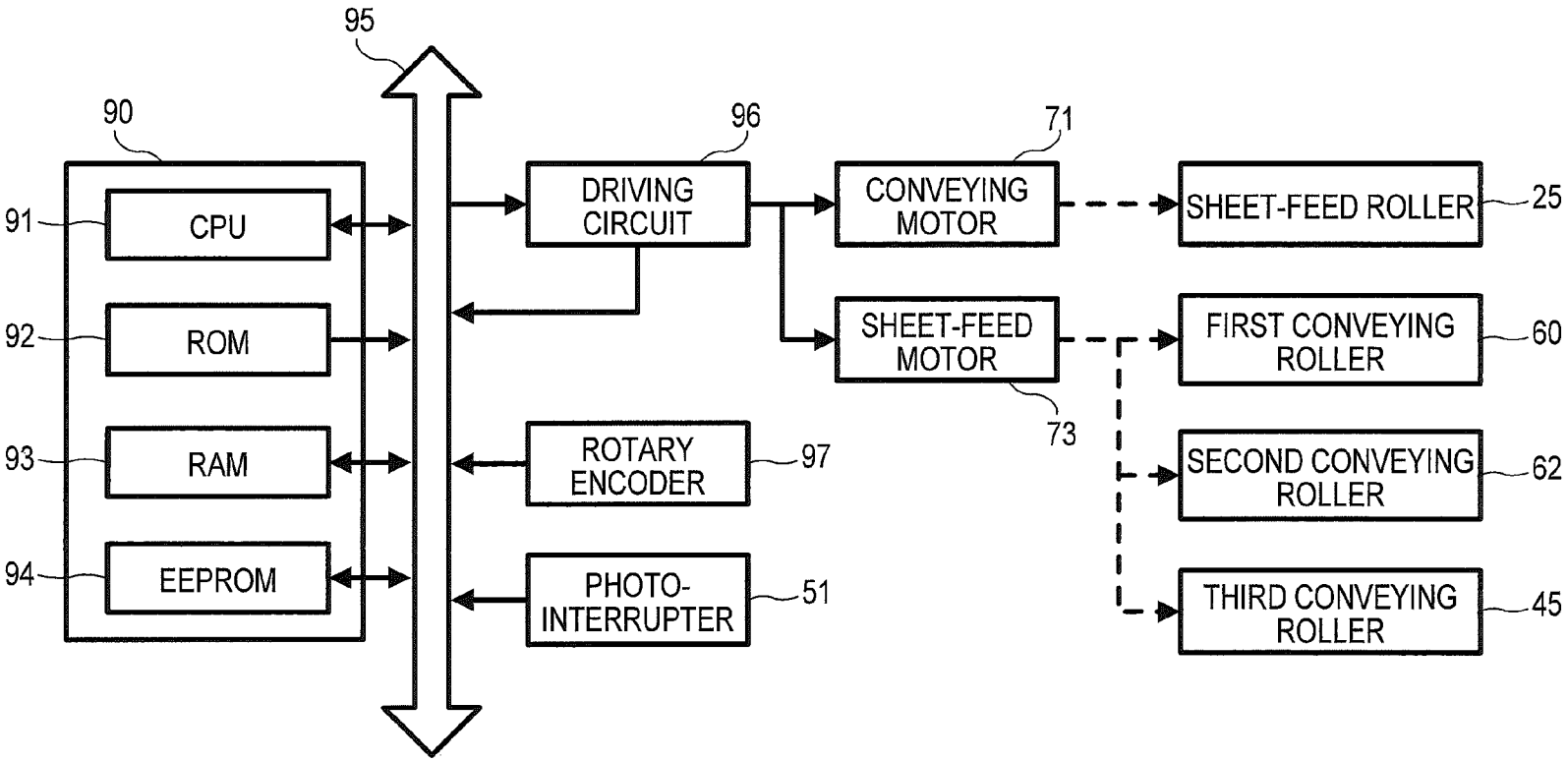
FIG. 4 is a block diagram showing the structure of a control unit.

Referring to FIG. 4, the structure of the control unit 90 of the multifunction device 10 will be described. FIG. 4 is a block diagram showing the structure of the control unit 90 of the multifunction device 10. Although the control unit 90 controls the overall operation of the multifunction device 10, a detailed description of the control of the scanner unit 12 and the recording unit 24 will be omitted. In this embodiment, the control unit 90 provides conveyance control means of the present invention.

The control unit 90 is configured as a micro computer consisting mainly of a central processing unit (CPU) 91 for performing calculation, a read-only memory (ROM) 92 that stores a control program etc., a random access memory (RAM) 93 that is used as a data storage area or an operation area, and an electrically erasable programmable read-only memory (EEPROM) 94 that stores setting information. These components are connected to one another via a bus 95 so as to be able to transfer the data.

A driving circuit 96 is connected to the bus 95. The driving circuit 96 drives the conveying motor 73 connected to the first conveying roller 60, the second conveying roller 62, the third conveying roller 45, etc., and the sheet-feed motor 71 connected to the sheet-feed roller 25. The driving circuit 96 includes drivers for driving the conveying motor 73 and the sheet-feed motor 71. The conveying motor 73 and the sheet-feed motor 71 are independently controlled by these drivers. The rotational force of the conveying motor 73 is transmitted to the first conveying roller 60, the second conveying roller 62, and the third conveying roller 45 via a known drive-transmission mechanism, and the rotational force of the sheet-feed motor 71 is transmitted to the sheet-feed roller 25.

In the multifunction device 10 according to this embodiment, the conveying motor 73 serves as a driving source for the first and second conveying rollers 60 and 62 that convey the recording sheet toward the platen 42, or convey the recording sheet positioned on the platen 42 or the recording sheet after recording toward the output-sheet holder 79. Furthermore, the conveying motor 73 serves as a driving source for rotating the third conveying roller in the forward- or reverse-rotation direction.

Moreover, the photo-interrupter 51 and a rotary encoder 97 for detecting the number of rotations of the third conveying roller 45 driven by the conveying motor 73 are connected to the bus 95. The control unit 90 can obtain the information about the presence/absence of the recording sheet in the sheet output path 65B, the passing position of the leading end or trailing end of the recording sheet in the sheet output path 65B, and the conveyance amount of the recording sheet, on the basis of the level of the output signal of the photo-interrupter 51 and the encoding amount detected by the rotary encoder 97.

[Duplex Image Recording Operation]

Figure 5:
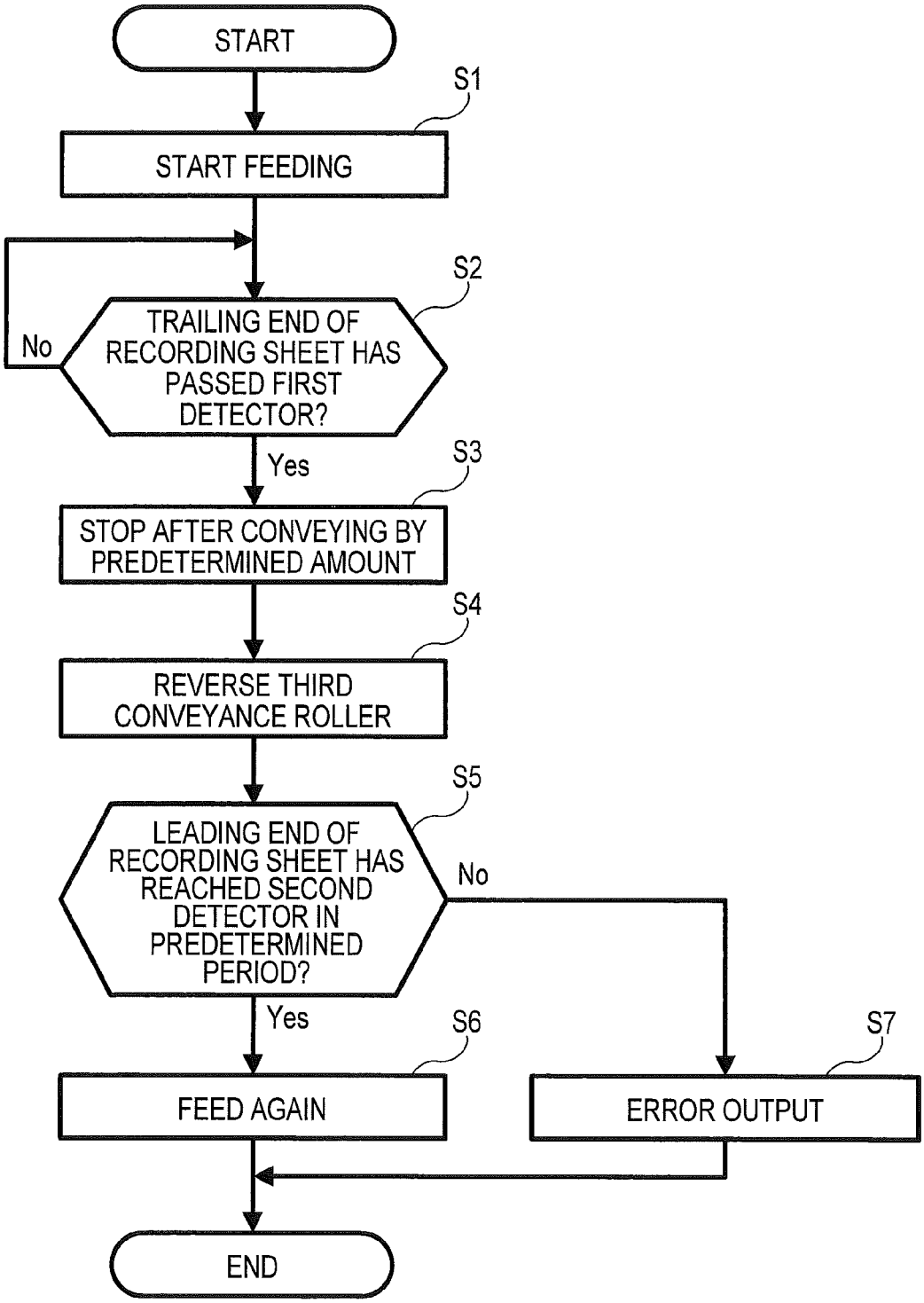
FIG. 5 is a flowchart showing an example of a switch-back processing sequence performed by the control unit during duplex image recording.

Referring to a flowchart in FIG. 5 and the schematic cross sections in FIGS. 6A to 9G, a duplex image recording operation of the printer unit 11 will be described. FIG. 5 is a flowchart showing an example of a switch-back processing sequence performed by the control unit 90 during duplex image recording. FIGS. 6A to 9G are schematic cross sections showing a recording sheet S being conveyed during duplex image recording in a chronological order. For simplicity's sake, the following description will be given on the assumption that image recording is performed on the recording sheet S accommodated in the second tray 21.

When images are recorded on both sides of the recording sheet S, first, the sheet-feed motor 71 is driven to cause the sheet-feed roller 25 to feed the recording sheet S from the second tray 21 (step S1). The recording sheet S fed from the second tray 21 is guided by the outer guide member 18 and the inner guide member 19 and is conveyed along the curved path 65A from below to above, so as to make a U-turn, to the recording unit 24. At this time, the recording sheet S is reversed such that the surface opposite the surface having been in contact with the sheet-feed roller 25 (surface) faces the recording unit 24. When the recording sheet S reaches the first conveying roller 60 and the pinch roller 61, the first conveying roller 60 and the pinch roller 61 convey the recording sheet S to the nip of the recording unit 24 and the platen 42. Then, the recording unit 24 starts image recording. The recording sheet S, on the surface of which an image is recorded by the recording unit 24, is conveyed by the second conveying roller 62 and the spur roller 63 to the sheet output path 65B. Note that, when the recording sheet S reaches the first conveying roller 60 and the pinch roller 61, the rotation of the sheet-feed roller 25 is stopped and the recording sheet S is conveyed by the first conveying roller 60 and the pinch roller 61.

Figure 6A:
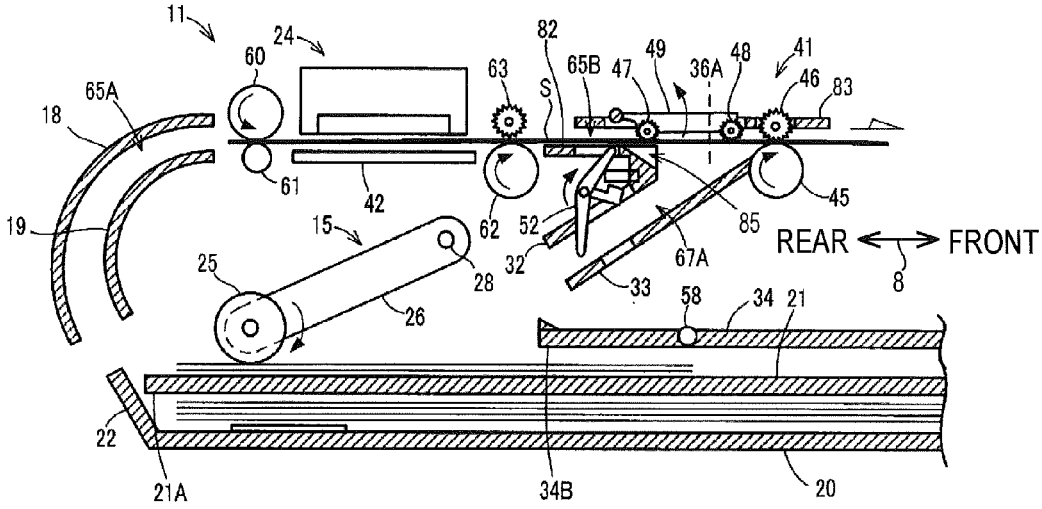
FIGS. 6A and 6B are schematic cross sections showing a recording sheet being conveyed during duplex image recording in a chronological order.
Figure 6B:
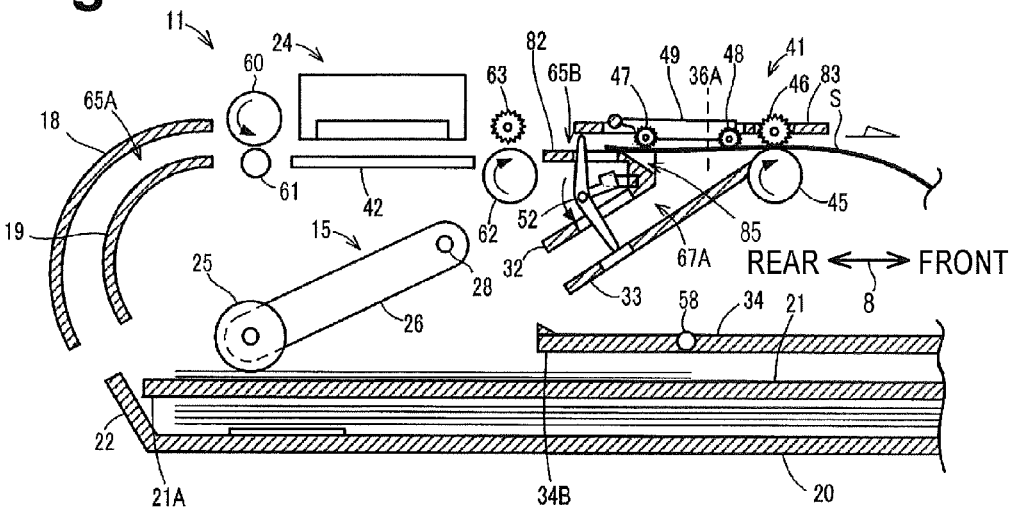

When the leading end of the recording sheet S conveyed along the sheet output path 65B reaches the first detector 52A, the rotary member 52 rotates clockwise in FIGS. 6A and 6B. At this time, along with the rotation of the rotary member 52, the third detector 52C rotates in the same direction and retracts from the optical path of the photo-interrupter 51. As a result, the output signal of the photo-interrupter 51 changes from LO level to HIGH level. The control unit 90 detects a change in signal level and determines the position of the leading end of the recording sheet S in the sheet output path 65B. That is, the control unit 90 detects whether or not the leading end of the recording sheet S has reached the first detector 52A.

When the recording sheet S is conveyed further and the leading end thereof reaches a position below the flap 49, the leading end of the recording sheet S collides with the auxiliary roller 47. At this time, the recording sheet S exerts a force that rotates the flap 49 upward. As shown in FIG. 6A, receiving this force, the flap 49 changes its orientation from the second orientation to the first orientation. Thus, a conveying path from the lower guide member 82 to the third conveying roller 45 is formed. Thereafter, when the leading end of the recording sheet S reaches the third conveying roller 45 and the spur roller 46, the third conveying roller 45 and the spur roller 46 convey the recording sheet S toward the output-sheet holder 79.

When the recording sheet S is conveyed further toward the output-sheet holder 79 and the trailing end of the recording sheet S passes the first detector 52A, the force applied by the recording sheet S to the first detector 52A is released. Thus, the rotary member 52 rotates counterclockwise in FIG. 6B by an elastic member (not shown) provided on the support shaft 53 and returns to an initial orientation shown in FIG. 6B. At this time, because the third detector 52C enters the optical path of the photo-interrupter 51, the output signal of the photo-interrupter 51 changes from HIGH level to LO level. The control unit 90 detects a change in signal level at this time and determines the position of the trailing end of the recording sheet S in the sheet output path 65B. That is, the control unit 90 detects whether or not the trailing end of the recording sheet S has passed the first detector 52A (step S2).

Immediately after the trailing end of the recording sheet S has passed the first detector 52A, as shown in FIG. 6B, the recording sheet S is in a first supported state in which the trailing end thereof is supported by the lower guide member 82. That is, the recording sheet S is, substantially, supported by both the lower guide member 82 and the third conveying roller 45. In this embodiment, the recording sheet S resists an urging force exerted by the flap 49 tending to assume the second orientation and maintains the first supported state. Thus, the flap 49 maintains the first orientation. The urging force exerted by the flap 49 tending to assume the second orientation is set smaller than a reaction force exerted by the recording sheet S in the first supported state, which pushes back the flap 49 upward. Thus, the flap 49 can be maintained in the second orientation when the recording sheet S is in the first supported state. In addition, the recording sheet S pushed downward by the flap 49 is not bent significantly.

When the control unit 90 detects that the trailing end of the recording sheet S has passed the first detector 52A, the control unit 90 stops rotation of the third conveying roller 45 after conveying the recording sheet S by a predetermined amount (step S3). The "predetermined amount" equals to the number of rotations of the third conveying roller 45 corresponding to the distance from the first detector 52A to the central portion 36A of the branch port 36. Herein, the central portion 36A of the branch port 36 is positioned between the downstream end of the lower guide member 82 and the auxiliary roller 48 of the flap 49. That is, the control unit 90 stops the conveyance of the recording sheet S when the trailing end of the recording sheet S has reached the central portion 36A of the branch port 36.

Whether or not the trailing end of the recording sheet S has reached the central portion 36A of the branch port 36 is determined on the basis of the output signal of the photo-interrupter 51 and the rotation-number signal input from the rotary encoder 97. More specifically, when the control unit 90 detects that the trailing end of the recording sheet S has passed the first detector 52A on the basis of the output signal of the photo-interrupter 51, the control unit 90 calculates the conveyance amount of the recording sheet S on the basis of the rotation-number signal input from the rotary encoder 97. Then, when the conveyance amount has reached the predetermined amount, the control unit 90 determines that the trailing end of the recording sheet S has reached the central portion 36A of the branch port 36. Thereafter, the control unit 90 stops the conveying motor 73. Thus, the recording sheet S temporarily stops in a second supported state (see FIG. 7C) in which the trailing end of the recording sheet S is positioned at the central portion 36A of the branch port 36.

In the second supported state, the trailing end of the recording sheet S is positioned at the central portion 36A of the branch port 36. In other words, the recording sheet S is not supported by the lower guide member 82 and is in contact with the auxiliary roller 48. In this embodiment, the urging force exerted by the flap 49 tending to assume the second orientation is set larger than the reaction force exerted by the recording sheet S in the second supported state, which pushes back the flap 49 upward. Therefore, when the recording sheet S is in the second supported state, the recording sheet S cannot resist the pressing force based on a self-weight of the flap 49, and thus, the flap 49 rotates from the first orientation to the second orientation (see FIG. 7D). At this time, the trailing end of the recording sheet S is urged toward the lower inclined guide member 33 by the auxiliary roller 48 of the flap 49 and maintains the orientation thereof. That is, the flap 49 is maintained in the second orientation, and the upstream end (the end oriented toward the reverse-conveying path 67) of the recording sheet S enters the reverse-conveying path 67 from the branch port 36.

Figure 7C:
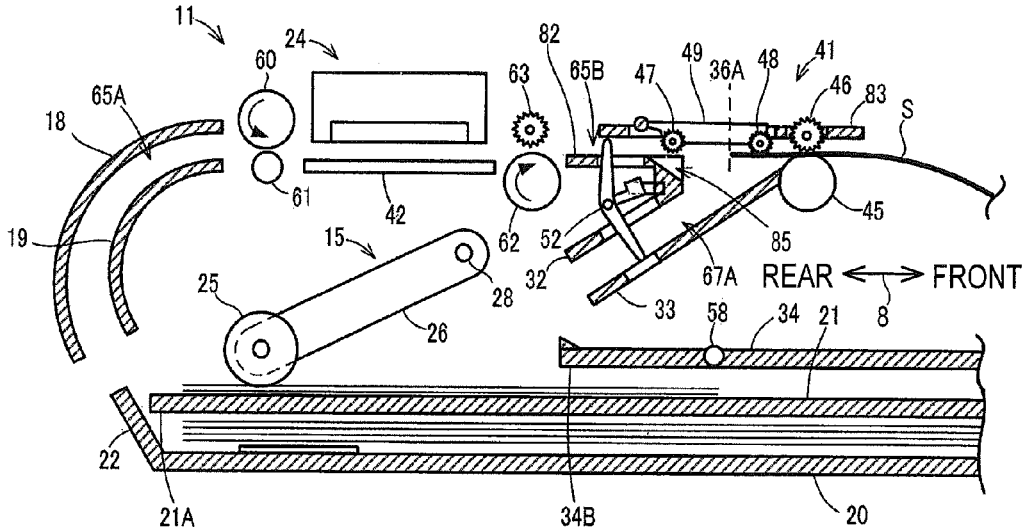
FIGS. 7C and 7D are schematic cross sections showing the recording sheet being conveyed during duplex image recording in a chronological order.
Figure 7D:
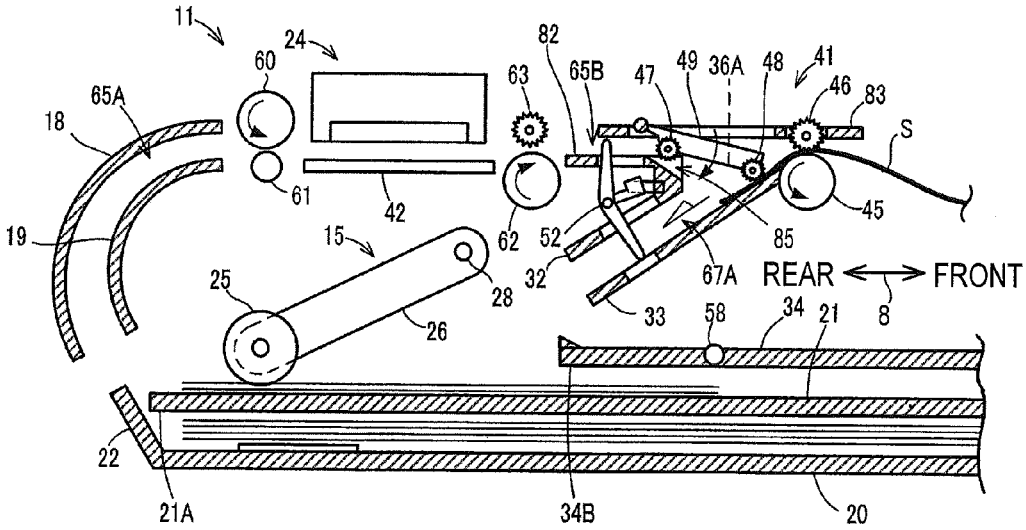

Then, the control unit 90 reversely rotates the conveying motor 73 to reverse the rotation direction of the third conveying roller 45, while the upstream end of the recording sheet S is sandwiched between the third conveying roller 45 and the spur roller 46 (step S4, see FIG. 7D). As a result, the recording sheet S is switched back near the branch port 36 and is conveyed along the reverse-conveying path 67. Note that the driving power, in the reverse-rotation direction, of the third conveying roller 45 is transmitted to the slide guide 34 via a drive-transmission mechanism (not shown) such as a rack-and-pinion. Thus, the slide guide 34 moves from the retracted position (see FIG. 2) to the guide position (see FIG. 8F). In this process of sliding the slide guide 34, the sheet-feed arm 26 is pushed upward by the slide guide 34, and the sheet-feed roller 25 is disposed on the slide guide 34. At this time, the sheet-feed roller 25 comes into contact with the roller 58 supported by the slide guide 34.

Figure 8E:
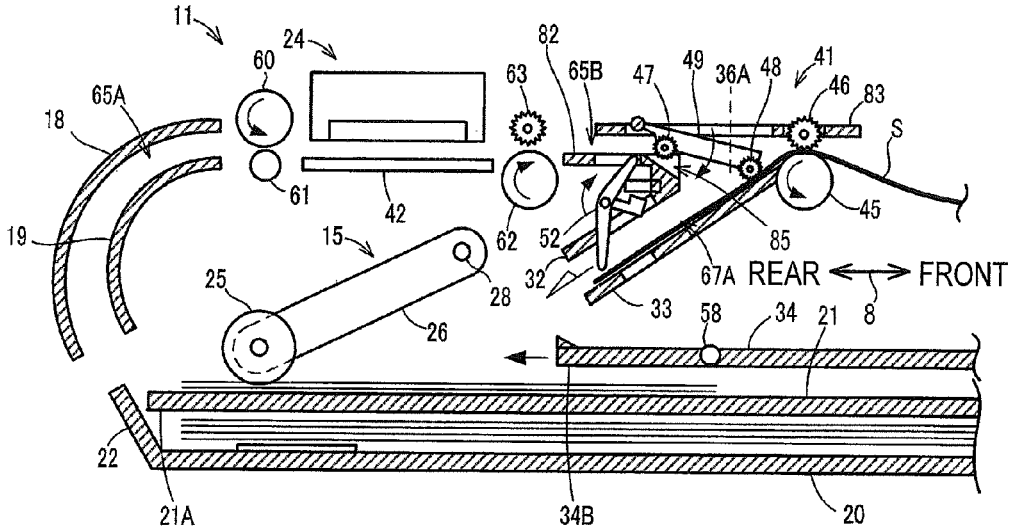
FIGS. 8E and 8F are schematic cross sections showing the recording sheet being conveyed during duplex image recording in a chronological order.
Figure 8F:
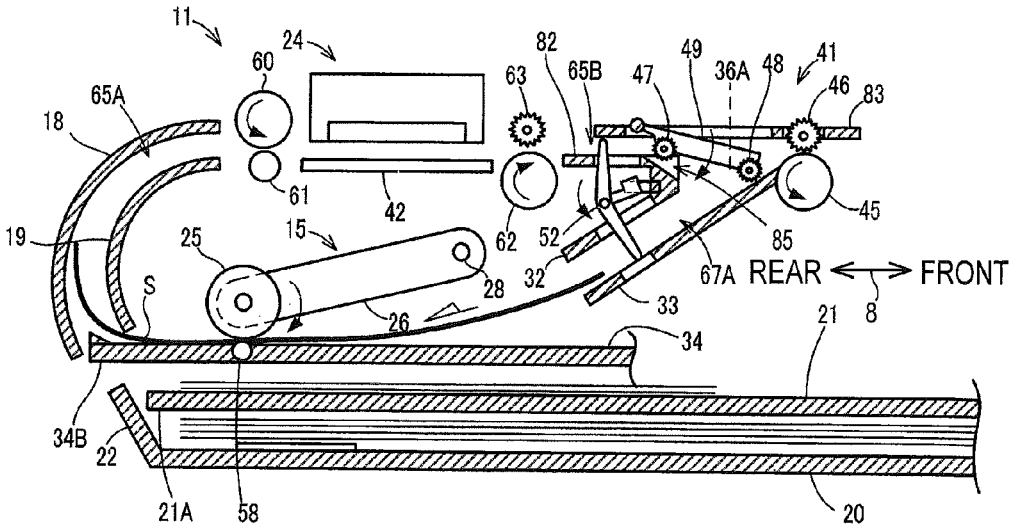
Figure 9G:
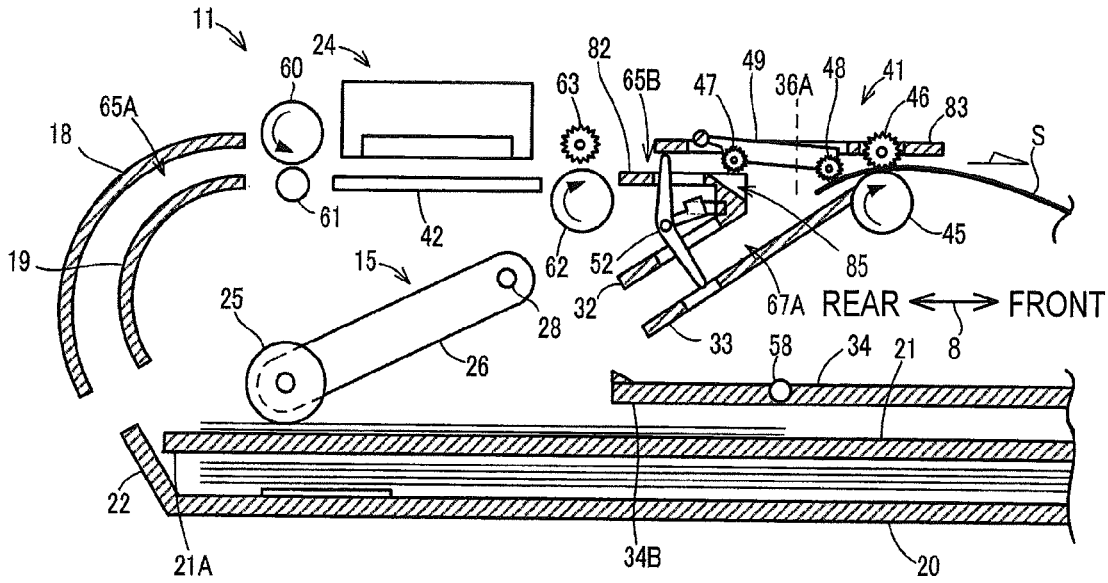
FIG. 9G is a schematic cross section showing the recording sheet being conveyed during duplex image recording in a chronological order.

When the leading end (the end in the traveling direction after switching back) of the recording sheet S conveyed along the inclined path 67A of the reverse-conveying path 67 has reached the second detector 52B, the rotary member 52 rotates clockwise (see FIG. 8E). At this time, along with the rotation of the rotary member 52, the third detector 52C also rotates in the same direction and is retracted from the optical path of the photo-interrupter 51. As a result, the output signal of the photo-interrupter 51 changes from LO level to HIGH level. The control unit 90 detects a change in signal level at this time and determines the position of the leading end of the recording sheet S in the inclined path 67A. That is, the control unit 90 detects whether or not the leading end of the recording sheet S has reached the second detector 52B (step S5).

When the control unit 90 detects that the leading end of the recording sheet S has reached the second detector 52A, the control unit 90 restarts the sheet-feed roller 25. The rotation of the sheet-feed roller 25 rotates the roller 58. Thus, the recording sheet S in the reverse-conveying path 67, sandwiched between the sheet-feed roller 25 and the roller 58, is fed again to the curved path 65A (step S6). Then, when the recording sheet S is conveyed again to the recording unit 24, the recording unit 24 records an image on the other side. Thereafter, while being supported by the support surface 82B of the lower guide member 82, the recording sheet S having the images recorded on both sides is output to the output-sheet holder 79 by the third conveying roller 45 rotated again in the original rotation direction (the forward-rotation direction) (see FIG. 9G). At this time, the flap 49 is maintained in the first orientation.

On the other hand, when the leading end of the recording sheet S does not reach the second detector 52B in a predetermined period of time after the recording sheet S is switched back (No in step S5), it is regarded that an error such as paper jam occurs during switching back of the recording sheet S, and an error output is performed (step S7). More specifically, an alarm message is indicated, an error indicator light is lit, or an alarm sound is played, and then, the subsequent processing is aborted.

In this embodiment, since the flap 49 moves the trailing end of the recording sheet S toward the second guide member by shifting from the first supported state to the second supported state, damage to the trailing end of the sheet which is reversed and becomes a new leading end of the sheet can be reduced. Furthermore, since the distance from the rotating member to the reversing roller is short, the feeding device or the image recording apparatus with the feeding device can be downsized.

Furthermore, when the control unit 90 determines that the trailing end of the recording sheet S is positioned at the central portion 36A of the branch port 36, the third conveying roller 45 is reversely rotated and the recording sheet S is switched back. Therefore, the arrival of the trailing end of the recording sheet S at the central portion 36A of the branch port 36 is assuredly determined. Because the third conveying roller 45 is reversely rotated on the basis of this determination, the recording sheet S is assuredly switched back in a state in which the trailing end thereof is oriented toward the inclined path 67A by the flap 45. Thus, the recording sheet S moves downward from the branch port 36 and is conveyed along the lower inclined guide member 33.

Furthermore, the recess 85 is formed at the downstream end of the lower guide member 82. Therefore, even if the conveying path for the recording sheet S guided by the lower guide member 82 is designed to be narrow to reduce the height of the apparatus, the auxiliary roller 47 does not interfere with the lower guide member 82. Thus, it is possible to provide a sufficient rotation area in which the flap 49 can change from the first orientation to the second orientation.

Moreover, in this embodiment, the sheet sensor 50 is provided. Thus, the photo-interrupter 51 can detect two events, namely, the presence/absence of the recording sheet S conveyed by the lower guide member 82 and the presence/absence of the recording sheet S guided along the lower inclined guide member 33.

In this embodiment, a flap-like rotating member (flap 49) is used, but a lever-like rotating member may be used. In this case, a plurality of the lever-like rotating member may be disposed. Moreover, in this embodiment, in order that the flap 49 may be shifted from the first supported state to the second supported state, the self-weight of the flap 49 is used, but some kind of a driving means may be used. Moreover, the auxiliary roller 47 may not have a spur shape and may be just a protruding portion.

[First Modification]

Figure 10:
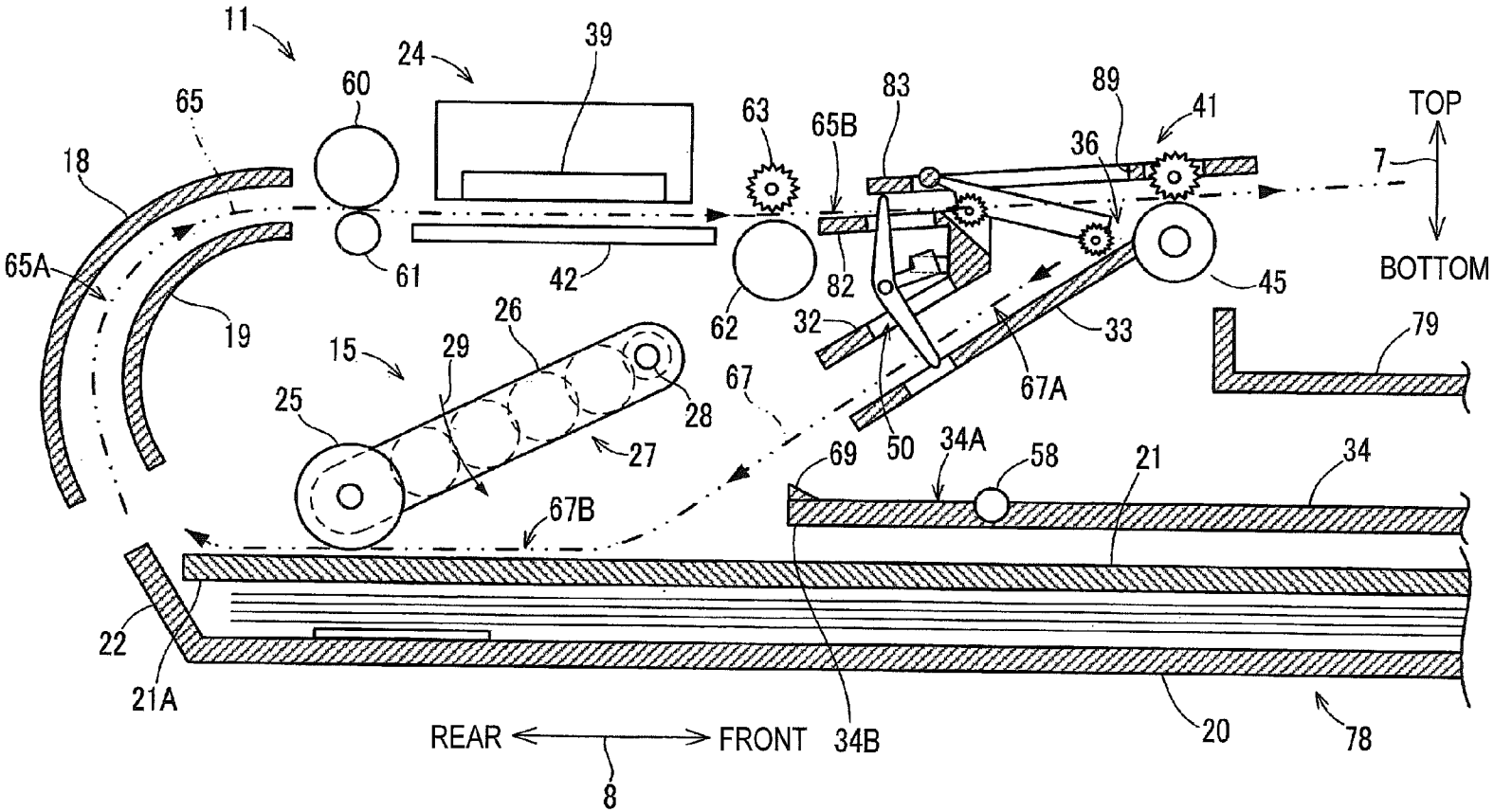
FIG. 10 is a schematic cross section showing a first modification of the present invention.

In the above-described embodiment, the sheet output path 65 is formed substantially horizontally by the lower guide member 82 extending horizontally in the front-rear direction 8. However, for example, as shown in FIG. 10, the sheet output path 65 may be inclined upward toward the front. More specifically, in FIG. 10, the lower guide member 82 is provided such that the support surface 82B thereof is inclined upward toward the front. The support surface 82B of the lower guide member 82 has, at the upstream end, substantially the same height as the support surface of the platen 42 and is gently inclined upward toward the downstream side. Furthermore, similarly to the lower guide member 82, the upper guide member 83 is inclined upward toward the front. Because the sheet output path 65 is formed in this manner, even if the leading end of the recording sheet S collides with the auxiliary roller 48 of the flap 49, the recording sheet S is bent so as to come into contact with the support surface 82B of the lower guide member 82 and the support surface of the platen 42. Therefore, the recording sheet S is conveyed over the platen 42 while preventing the trailing end of the recording sheet S from floating. Accordingly, an ink stain and degradation in image quality due to the trailing end of the recording sheet S touching the nozzle 39 of the recording unit 24 are prevented.

[Second Modification]

Figure 11:
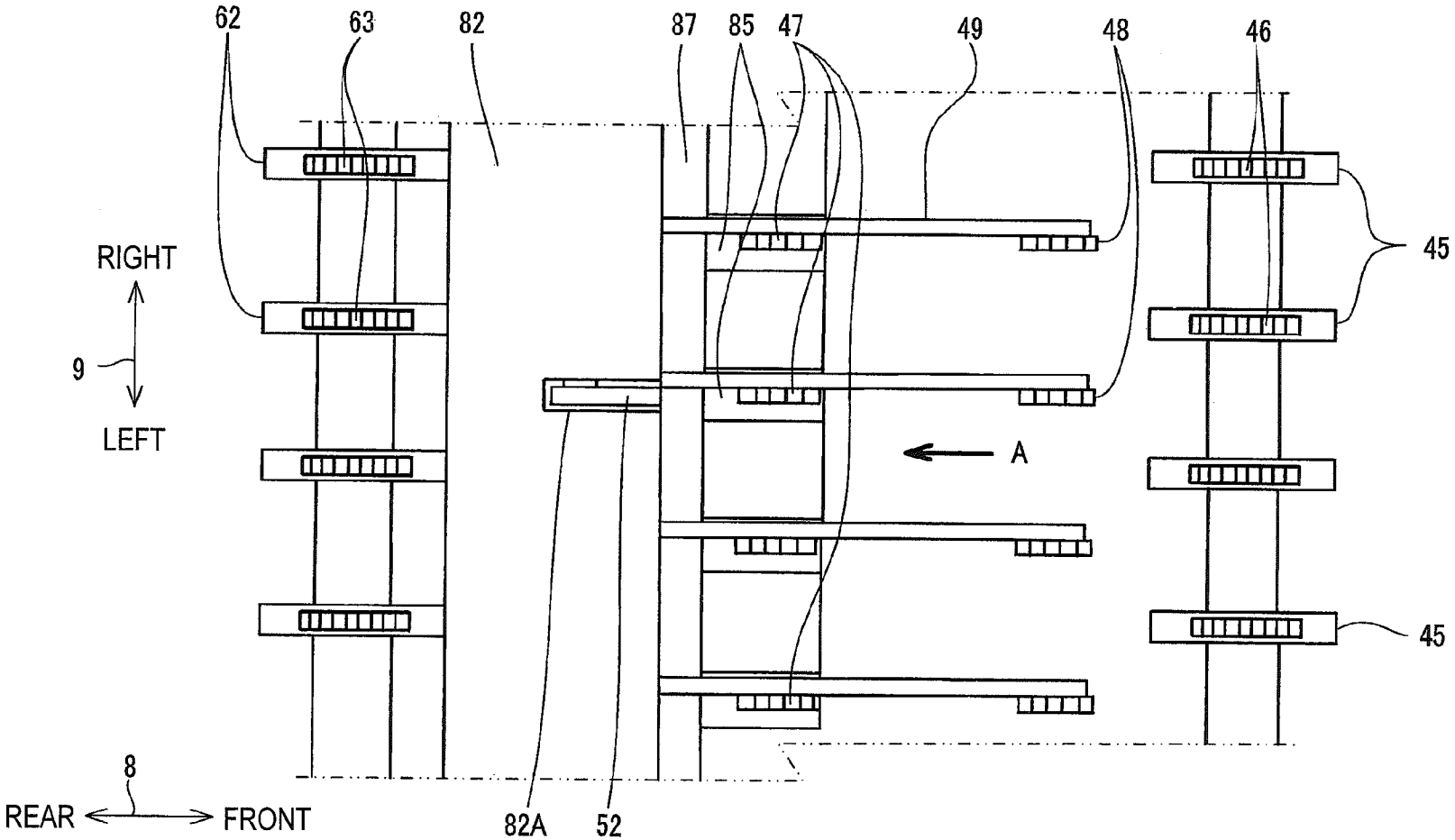
FIG. 11 is a schematic plan view showing the printer unit according to a second modification of the present invention.
Figure 12:
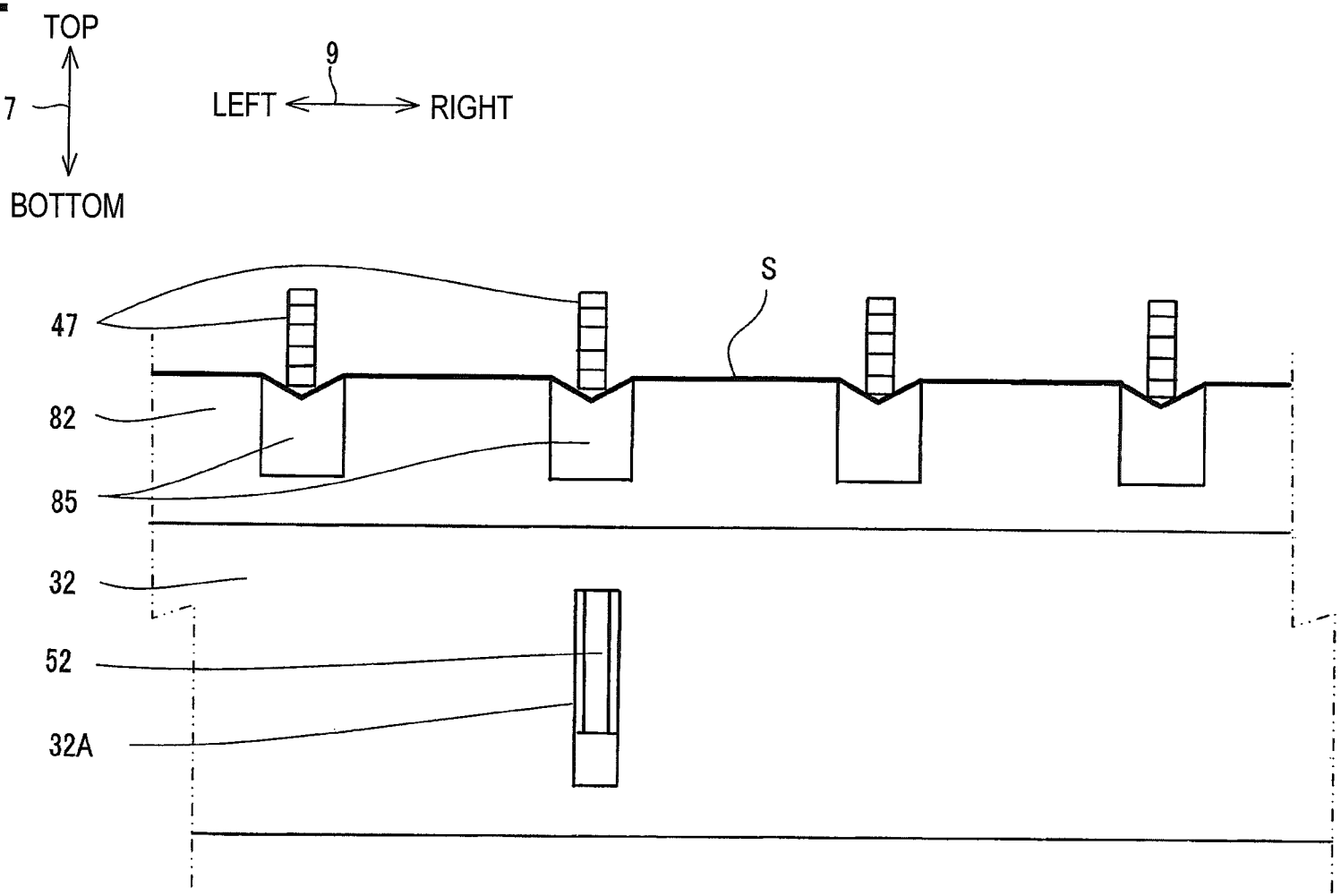
FIG. 12 is a schematic cross section on arrow A of FIG. 11 showing the printer unit from a downstream side according to the second modification of the present invention.

FIG. 11 is a plan view showing the printer unit in a state without the upper guide member 83. FIG. 12 is a view on arrow A of FIG. 11. In this embodiment, as shown in FIG. 11, an axial direction of the third conveying roller 45 is perpendicular to the conveying direction and a plurality of the third conveying rollers 45 are disposed to be separate from each other in the axial direction. Each of the auxiliary rollers 47 are disposed between one of the plurality of the conveying rollers 45 and another of the plurality of the conveying rollers 45 in the axial direction.

As shown in FIG. 12, when the leading end of the recording sheet S contacts the auxiliary roller 47, the leading end can be crinkled in the top-bottom direction 7. As described above, since each of the auxiliary rollers 47 are disposed between one of the plurality of the third conveying rollers 45 and another of the plurality of the third conveying rollers 45 in the right-left direction 9, a not-crinkled part of the leading end will be nipped between the third conveying roller 45 and the spur roller 46. Thus, even on a recording sheet with less rigidity, an image is printed in the high density without degrading the quality of the image recorded on the recording sheet.

What is claimed is:

1. A feeding device comprising:

a conveying roller configured to selectively rotate in a forward direction and a reverse direction, the conveying roller configured to convey a sheet toward a downstream side in a conveying direction when the conveying roller is rotated in the forward direction;

a first guide member positioned on an upstream side of the conveying roller in the conveying direction and configured to guide the conveyed sheet toward the conveying roller;

a second guide member configured to guide the conveyed sheet when the conveying roller rotates in the reverse direction; and a rotating member positioned between the first guide member and the conveying roller and comprising a support shaft and a pressing portion, wherein the rotating member is configured to rotate about the support shaft between a first supported state where the rotating member is separated from the second guide member, and a second supported state where the rotating member is closer to the second guide member than when the rotating member is in the first supported state, wherein when the rotating member is in the first supported state, the rotating member is positioned to allow the sheet to be conveyed from the first guide member to the conveying roller, and wherein the rotating member is configured to move a trailing end of the sheet toward the second guide member by transitioning from the first supported state to the second supported state, and wherein the first guide member and the rotating member are configured such that the sheet pushes up the rotating member from the second supported state to the first supported state.

2. The feeding device according to claim 1, wherein the rotating member is configured to press the trailing end of the sheet toward the second guide member with a pressing force, wherein the pressing force is smaller than a reaction force exerted by the sheet when the sheet is supported by the first guide member, and the pressing force is larger than a reaction force exerted by the sheet when the trailing end of the sheet has passed beyond the first guide member in the conveying direction.

3. The feeding device according to claim 2, wherein the pressing force is relative to a weight of the rotating member.

4. The feeding device according to claim 1, wherein the rotating member is configured to transition to the first supported state when the sheet conveyed from the upstream side in the conveying direction contacts the rotating member.

5. The feeding device according to claim 4, wherein the rotating member comprises a protruding portion that contacts the sheet when the rotating member is in the first supported state.

6. The feeding device according to claim 5, wherein the protruding portion comprises a roller.

7. The feeding device according to claim 6, wherein the roller has a spur shape.

8. The feeding device according to claim 1, wherein the pressing portion comprises a roller.

9. The feeding device according to claim 8, wherein the roller has a spur shape.

10. The feeding device according to claim 1, wherein the first guide member has a recess formed therein at an end of the downstream side of the first guide member, and when the rotating member is in the second supported state, at least a portion of the rotating member is positioned in the recess.

11. The feeding device according to claim 10, wherein the rotating member comprises a spur roller, and when the rotating member is in the second supported state, at least a portion of the spur roller is positioned in the recess.

12. The feeding device according to claim 1, wherein the support shaft is positioned above the first guide member.

13. The feeding device according to claim 1, wherein when the rotating member is in the first supported state, the sheet is positioned between the rotating member and the first guide member.

14. The feeding device according to claim 1, wherein when the rotating member is in the second supported state, the sheet is positioned between the rotating member and the second guide member.

15. The feeding device according to claim 1, wherein the rotating member has a flap shape and configuration.

16. The feeding device according to claim 1, further comprising a plurality of additional conveying rollers, wherein an axial direction of the conveying roller is perpendicular to the conveying direction and the plurality of the additional conveying rollers are aligned in the axial direction and positioned to be separated from each other, and the pressing portion is positioned between the conveying roller and one of the plurality of the additional conveying rollers, in the axial direction.

17. The feeding device according to claim 1, wherein the rotating member transitions from the first supported state to the second supported state by its own weight.

18. An image recording apparatus comprising:

a recording unit configured to record an image on a recording medium; and a feeding device comprising:

a conveying roller configured to selectively rotate in a forward direction and a reverse direction, the conveying roller configured to convey a sheet toward a downstream side in a conveying direction when the conveying roller is rotated in the forward direction;

a first guide member positioned on an upstream side of the conveying roller in the conveying direction and configured to guide the conveyed sheet toward the conveying roller;

a second guide member configured to guide the conveyed sheet when the conveying roller rotates in the reverse direction; and a rotating member positioned between the first guide member and the conveying roller and comprising a support shaft and a pressing portion, wherein the rotating member is configured to rotate about the support shaft between a first supported state where the rotating member is separated from the second guide member, and a second supported state where the rotating member is closer to the second guide member than when the rotating member is in the first supported state, wherein when the rotating member is in the first supported state, the rotating member is positioned to allow the sheet to be conveyed from the first guide member to the conveying roller, and wherein the rotating member is configured to move a trailing end of the sheet toward the second guide member by transitioning from the first supported state to the second supported state, and wherein the first guide member and the rotating member are configured such that the sheet pushes up the rotating member from the second supported state to the first supported state.

* * * * *